US009539636B2

(12) United States Patent
Banik et al.

(10) Patent No.: US 9,539,636 B2
(45) Date of Patent: Jan. 10, 2017

(54) ARTICLES, SYSTEMS, AND METHODS FOR FORGING ALLOYS

(71) Applicant: ATI PROPERTIES, INC., Albany, OR (US)

(72) Inventors: Anthony Banik, Charlotte, NC (US); Ramesh S. Minisandram, Charlotte, NC (US); Christopher M. O'Brien, Monroe, NC (US)

(73) Assignee: ATI Properties LLC, Albany, OR (US)

( * ) Notice: Subject to any disclaimer, the term of this patent is extended or adjusted under 35 U.S.C. 154(b) by 589 days.

(21) Appl. No.: 13/833,043

(22) Filed: Mar. 15, 2013

(65) Prior Publication Data

US 2014/0271337 A1 Sep. 18, 2014

(51) Int. Cl.

| | |
|---|---|
| ***B21J 13/02*** | (2006.01) |
| ***C22C 19/05*** | (2006.01) |
| ***B21J 1/06*** | (2006.01) |
| ***B21J 3/00*** | (2006.01) |

(52) U.S. Cl.

CPC *B21J 13/02* (2013.01); *B21J 1/06* (2013.01); *B21J 3/00* (2013.01); *C22C 19/051* (2013.01)

(58) Field of Classification Search

CPC ..... B21J 1/00; B21J 1/003; B21J 1/06; B21J 3/00; B21J 5/02; B21J 13/02; B21C 23/01; B21C 23/32; C10N 2240/402; B21D 35/007; B21D 37/18

USPC ..... 72/41, 42

See application file for complete search history.

(56) References Cited

U.S. PATENT DOCUMENTS

| | | | | |
|---|---|---|---|---|
| 899,827 | A | 9/1908 | Cutter | |
| 2,191,478 | A | 2/1940 | Hopkins | |
| 2,295,702 | A | 9/1942 | Wissler | |
| 2,630,220 | A * | 3/1953 | Sejournet | 72/42 |
| 2,653,026 | A * | 9/1953 | Feltus | F41J 1/01 273/362 |
| 2,706,850 | A * | 4/1955 | Lambert et al. | 29/423 |
| 2,893,555 | A * | 7/1959 | Buffet et al. | 72/41 |
| 3,001,059 | A | 9/1961 | Jones | |
| 3,021,594 | A | 2/1962 | Clatot et al. | |

(Continued)

FOREIGN PATENT DOCUMENTS

| | | | |
|---|---|---|---|
| CN | 85103156 | A | 3/1986 |
| CN | 101195871 | A | 6/2008 |

(Continued)

OTHER PUBLICATIONS

Belfort, M.G. and V.E. Patton, "Equipment for arc and slag welding and weld deposition", Moscow, High School, 1974.

(Continued)

*Primary Examiner* — Edward Tolan

(74) *Attorney, Agent, or Firm* — K&L Gates LLP

(57) ABSTRACT

A system and method of processing an alloy ingot or other alloy workpiece to reduce thermal cracking and reduce friction between the workpiece and the forging die may generally comprise positioning a multi-layer pad between the workpiece and the forging die. An article for processing an alloy ingot or other alloy workpiece to reduce thermal cracking also is disclosed. The present disclosure also is directed to an alloy workpieces processed according to the methods described herein, and to articles of manufacture including or made from alloy workpieces made according to these methods.

10 Claims, 9 Drawing Sheets

(56) References Cited

U.S. PATENT DOCUMENTS 3,122,828 A 3/1964 Havel
3,127,015 A * 3/1964 Schieren ..... B21C 23/32 29/424
3,181,324 A * 5/1965 Labino ..... 72/42
3,339,271 A 9/1967 Durfee et al.
3,390,079 A * 6/1968 Utakoji ..... B21C 23/32 508/137
3,423,975 A * 1/1969 Collinet ..... 72/42
3,431,597 A 3/1969 Nowak et al.
3,446,606 A 5/1969 Friedrich et al.
3,493,713 A 2/1970 Johnson
3,566,661 A * 3/1971 McCafferty et al. .... B21D 5/08 29/423
3,617,685 A 11/1971 Brill-Edwards et al.
3,690,135 A * 9/1972 Gagin et al. ..... 72/42
3,693,419 A 9/1972 De Pierre et al.
3,814,212 A 6/1974 Latos
3,863,325 A 2/1975 Gurganus et al.
3,869,393 A 3/1975 Booker
3,959,543 A 5/1976 Ellis
3,979,815 A * 9/1976 Nakanose ..... B21D 22/00 29/421.1
3,992,202 A 11/1976 Dulis et al.
4,055,975 A 11/1977 Serfozo et al.
4,060,250 A 11/1977 Davis et al.
4,217,318 A 8/1980 Anderson
4,226,758 A * 10/1980 Sumira ..... 523/153
4,257,812 A * 3/1981 Johnson et al. ..... 501/95.2
4,544,523 A 10/1985 McCollough et al.
4,728,448 A 3/1988 Sliney
4,744,504 A 5/1988 Turner
4,780,484 A 10/1988 Schubert et al.
4,843,856 A * 7/1989 Bhowal ..... B21J 3/00 228/235.1
4,935,198 A 6/1990 Tornberg
4,961,991 A 10/1990 Howard
5,052,464 A 10/1991 Natori
5,259,965 A 11/1993 Kishi et al.
5,263,349 A 11/1993 Felix et al.
5,298,095 A 3/1994 Russo et al.
5,302,414 A 4/1994 Alkhimov et al.
5,348,446 A 9/1994 Lee et al.
5,374,323 A 12/1994 Kuhlman et al.
5,525,779 A 6/1996 Santella et al.
5,665,180 A 9/1997 Seetharaman et al.
5,743,120 A 4/1998 Balliett
5,743,121 A 4/1998 Miller
5,783,530 A 7/1998 Foster et al.
5,788,142 A 8/1998 Bigay et al.
5,902,762 A 5/1999 Mercuri et al.
5,908,670 A 6/1999 Dunkerley et al.
5,951,792 A 9/1999 Balbach
5,989,487 A 11/1999 Yoo et al.
6,006,564 A 12/1999 Frisby et al.
6,120,624 A 9/2000 Vogt et al.
6,154,959 A 12/2000 Goodwater et al.
6,202,277 B1 * 3/2001 Zahedi ..... B22F 3/1241 249/112
6,269,669 B1 8/2001 Matsubara et al.
6,309,591 B1 10/2001 Yoo et al.
6,312,022 B1 11/2001 Brophy, III et al.
6,329,079 B1 12/2001 Meyer
6,330,818 B1 12/2001 Jain
6,418,795 B2 7/2002 Im et al.
6,484,790 B1 11/2002 Myers et al.
6,547,952 B1 4/2003 Staerzl
6,623,690 B1 9/2003 Rizzo et al.
6,753,504 B2 6/2004 Keller et al.
6,773,824 B2 8/2004 Rizzo et al.
6,774,346 B2 8/2004 Clothier
6,865,917 B2 3/2005 Golovashchenko et al.
6,933,058 B2 8/2005 Darolia et al.
7,000,306 B2 2/2006 Rice et al.
7,108,483 B2 9/2006 Segletes et al.
7,114,548 B2 10/2006 Forbes Jones
7,172,820 B2 2/2007 Darolia et al.
7,188,498 B2 3/2007 Browne et al.
7,208,116 B2 4/2007 Manning et al.
7,257,981 B2 8/2007 Natsui et al.
7,264,888 B2 9/2007 Darolia et al.
7,288,328 B2 10/2007 Darolia et al.
7,316,057 B2 1/2008 Seth
7,357,958 B2 4/2008 Darolia et al.
7,516,526 B2 4/2009 Rice et al.
7,618,684 B2 11/2009 Nesbitt
7,722,330 B2 5/2010 Seth
7,770,427 B2 8/2010 Nakahara et al.
7,927,085 B2 4/2011 Hall et al.
8,230,899 B2 7/2012 Minisandram
8,303,289 B2 11/2012 Goller et al.
8,327,681 B2 12/2012 Davidson et al.
8,376,726 B2 2/2013 Goller et al.
8,545,994 B2 10/2013 Facchini et al.
8,567,226 B2 10/2013 Morales
2002/0005233 A1 1/2002 Schirra et al.
2002/0019321 A1 2/2002 Balliett et al.
2004/0079453 A1 4/2004 Groh et al.
2004/0105774 A1 6/2004 Del Corso et al.
2005/0044800 A1 3/2005 Hall et al.
2005/0273994 A1 12/2005 Bergstrom et al.
2006/0239852 A1 10/2006 Shipton et al.
2011/0195270 A1 8/2011 De Souza et al.
2011/0302978 A1 12/2011 Oppenheimer et al.
2011/0302979 A1 12/2011 Oppenheimer et al.
2012/0183708 A1 7/2012 Minisandram
2012/0279678 A1 11/2012 Minisandram
2013/0142686 A1 6/2013 Lipetzky
2014/0246165 A1 9/2014 Minisandram
2014/0260478 A1 9/2014 Forbes Jones et al.
2014/0290321 A1 10/2014 Minisandram

FOREIGN PATENT DOCUMENTS

CN 101412066 A 4/2009
CN 101517112 A 8/2009
EP 386515 2/1990
EP 0767028 4/1997
EP 0969114 1/2000
EP 1197570 4/2002
EP 2286942 A1 2/2011
GB 684013 A 12/1952
GB 1202080 A 8/1970
GB 1207675 A 10/1970
GB 2190319 A 11/1987
GB 2262540 A 6/1993
JP 52-114524 A 9/1977
JP 53-108842 A 9/1978
JP 54-52656 A 4/1979
JP 56-109128 A 8/1981
JP S57-209736 A 12/1982
JP 59-179214 A * 10/1984 ..... B21C 23/32
JP 61-255757 A 11/1986
JP 61-269929 A 11/1986
JP 1-271021 10/1989
JP H01-274319 11/1989
JP H02-104435 A 4/1990
JP H02-107795 A 4/1990
JP H03-174938 A 7/1991
JP 4-118133 A 4/1992
JP 6-63743 A 3/1994
JP H07-3840 A 1/1995
JP 11-10222 A 1/1999
JP 11-320073 11/1999
JP 2000-288674 A 10/2000
JP 2000-312905 A 11/2000
JP 2003-239025 A 8/2003
JP 2003-260535 A 9/2003
JP 2005-40810 A 2/2005
JP 2009-66661 A 4/2009
JP 2010-519 A 1/2010
RU 2020020 C1 9/1994
RU 2070461 C1 12/1996
RU 2133652 C1 7/1999

(56) References Cited

FOREIGN PATENT DOCUMENTS

| | | | |
|---|---|---|---|
| RU | 2145981 | C1 | 2/2000 |
| RU | 2275997 | C2 | 5/2006 |
| RU | 2337158 | C2 | 10/2008 |
| RU | 2355791 | C2 | 5/2009 |
| SU | 435288 | A1 | 7/1974 |
| SU | 1015951 | A1 | 5/1983 |
| SU | 1076162 | A1 | 2/1984 |
| SU | 1299985 | A1 | 3/1987 |
| SU | 1540977 | A1 | 2/1990 |
| SU | 1761364 | A1 | 9/1992 |
| WO | WO 94/13849 | A1 | 6/1994 |
| WO | WO 95/35396 | | 12/1995 |
| WO | WO 98/05463 | A1 | 2/1998 |
| WO | WO 99/02743 | A1 | 1/1999 |
| WO | WO 01/12381 | | 2/2001 |
| WO | WO 02/27067 | A1 | 4/2002 |

OTHER PUBLICATIONS

Steel Handbook, 3rd Edition, Bar Steel/Steel Tube/Rolling Common Equipment, Edited by Iron and Steel Inst. of Japan, Jun. 27, 2010.

Atlan et al., Metal Forming: Fundamentals and Applications, Ch. 6. Friction in Metal Forming, ASM: 1983.

Donachie et al., Superalloys: A Technical Guide, Melting and Conversion, pp. 56-77, ASM International, 2002.

Paton et al., ESS LM as a way for heavy ingot manufacturing, LMPC, 2007.

ASTM E2465-06 (2006): Standard Test Method for Analysis of Ni-Base Alloys by X-ray Fluorescence Spectrometry.

ASTM E1019-08 (2008): Standard Test Methods for Determination of Carbon, Sulfur, Nitrogen, and Oxygen in Steel, Iron, Nickel, and Cobalt Alloys by Various Combustion and Fusion Techniques.

Santella, An overview of the welding of Ni3Al and Fe3Al alloys, ASME and ASM Materials Conference, Dec. 31, 1996.

Levin et al., Robotic weld overlay coatings for erosion control, Quarterly Technical Progress Report for U.S. DOE Grant No. DE-FG22-92PS92542, Lehigh University, Energy Research Center, Apr. 25, 1995.

Maziasz et al., Overview of the development of FeAl intermetallic alloys, Proceedings of the 2d International Conference on Heat-Resistant Materials, Sep. 1, 1995.

Ito et al., Blast erosion properties of overlay weld metal, Welding International, 5:3, 1991, pp. 192-197.

Horn et al., Auftragschweiβungen mit Hastelloy alloy B-42 (Overlay welding with Hastelloy B-42), Materials and Corrosion, 43:8, 1992, pp. 381-387.

Tillack, Weld fabrication of nickel-containing materials, Practical handbook of stainless steels & nickel alloys, Lamb ed., CASTI Publishing Inc., ASM International, Aug. 1999, pp. 325-370.

Insulating Method Improves Superalloy Forging, Baosteel Technical Research, Apr. 23, 2012, vol. 5, No. 4, 2 pages.

ITC-100, ITC-200, ITC-213 Ceramic Coatings, BCS International Technical Ceramics Coatings, http://budgetcastingsupply.com/ITC.php, Feb. 2013, 3 pages.

Carbon Steel, E-Z LOK, AISI 12L14 Steel, cold drawn, 19-38 mm round, Aug. 5, 2013, http://www.ezlok.com/TechnicalInfo/MPCarbonSteel.html, 1 page.

Alloy 309/309S, Specification Sheet: Alloy 309, Sandmeyer Steel Company, Aug. 5, 2013, http://www.sandmeyersteel.com/309-309S.html, 4 pages.

Shivpuri, R. and S. Kini, Lubricants and Their Applications in Forging, ASM Handbook, vol. 14A, Metalworking: Bulk Forming, Semiatin, S.L., ed., 2005, ASM International, Ohio, US, p. 84.

Schey et al., Laboratory Testing of Glass Lubricants, Lubrication Engineering/Tribology and Lubrication Technology, Society of Tribologists and Lubrication Engineers, US, vol. 30, No. 10, Oct. 1, 1974, pp. 489-497.

McGraw Hill Encyclopedia of Science and Technology, 1992, McGraw Hill Inc., vol. 11, pp. 32-33.

Chesney, Peter, A New Spray Coating Process for Manufacture of Stainless Steel Clad Construction Steel with Resistance to Corrosion by De-icing Salts & Seawater, Spray Forming International, Cayce, South Carolina, USA, Thermal Spray 2003: Advancing the Science and Applying the Technology, ASM International, 2003, 5 pages.

Anchor Industrial Sales, Inc. Product Data Sheets, Style #412 Fiberglass cloth, Style #412IB Fiberglass Mats, 2008, 2 pages.

"A New Nickel Superalloy", Machine Design, Hayes International Inc., published by Penton Publishing, Mar. 23, 2006, p. 41.

Crucible Compaction Metals P/M Low Carbon Astroloy, Supersolvus, printed from http://www/matweb.com/search/datasheet_print.aspx?matguid=e1bac255c1964e19a43b29 . . . on Aug. 17, 2011, 2 pages.

Gayda, John, "NASA/TM-2001-210814 High Temperature Fatigue Crack Growth Behavior of Alloy 10", Glenn Research Center, Cleveland, Ohio, National Aeronautics and Space Administration, Apr. 2001, 7 pages.

Advanced Solutions for Higher Performance and Longer Life, ATI Powder Metals Applications, printed from http://www.alleghenytechnologies.com/atipowder/applications/default.asp on Sep. 22, 2011, 4 pages.

Wlodek et al., "The Structure of Rene 88 DT", Superalloys 1996, Eds. Kissinger et al., The Minerals, Metals & Materials Society, 1996, pp. 129-136.

Zielinska et al., "Thermal properties of cast nickel based superalloys", Archives of Materials Science and Engineering, vol. 44, Issue 1, Jul. 2010, pp. 35-38.

Rockwell Hardness Testing, Materials Evaluation and Engineering, Inc., 2009, 2 pages.

* cited by examiner

ARTICLES, SYSTEMS, AND METHODS FOR FORGING ALLOYS

TECHNICAL FIELD

The present disclosure is directed to alloy ingots and other alloy workpieces. More particularly, the present disclosure is directed to articles, systems, and methods for processing alloy ingots and other alloy workpieces.

BACKGROUND

"Forging" refers to the working and/or shaping of a solid-state material by plastic deformation. Forging is distinguishable from the other primary classifications of solid-state material forming operations, i.e., machining (shaping of a workpiece by cutting, grinding, or otherwise removing material from the workpiece) and casting (molding liquid material that solidifies to retain the shape of a mold). "Forgeability" is the relative capacity of a material to plastically deform without failure. Forgeability depends on a number of factors including, for example, forging conditions (e.g., workpiece temperature, die temperature, and deformation rate) and material characteristics (e.g., composition, microstructure, and surface structure). Another factor that affects the forgeability of a given workpiece is the tribology of the interacting die surfaces and workpiece surfaces. The interaction between die surfaces and workpiece surfaces in a forging operation involves heat transfer, friction, and wear. As such, thermal insulation and/or lubrication between a workpiece and forging dies can influence forgeability.

Various alloys may be characterized as being "crack sensitive". Ingots and other workpieces composed of crack sensitive alloys may form cracks along their surfaces and/or edges during forging operations or internally if material at the surface and interior move at different rates. Forming articles from crack sensitive alloys may be problematic because, for example, cracks formed during forging or other hot working operations may need to be removed from the worked article, which increases production time and expense, while reducing yield.

It is known in the art to decrease friction during forging operations by using lubricants. Inadequate or inconsistent forging lubrication can result in non-uniform plastic deformation of the workpiece, which is generally undesirable. For example, non-uniform plastic deformation can result in "barreling" of the workpiece and/or the formation of voids in the workpiece during forging operations. However, prior forging lubricants may have various deficiencies that result in a sub-standard forged article.

Given the drawbacks of current forging techniques, it would be advantageous to provide a more efficient and/or more cost-effective method of forging alloys, especially crack sensitive alloys. Additionally, it would be advantageous to decrease the friction between dies and workpieces during forging operations. More generally, it would be advantageous to provide an improved method for forging alloy ingots and other alloy workpieces.

SUMMARY

According to certain non-limiting embodiments, articles, systems, and methods for processing alloy ingots and other alloy workpieces are described.

Various non-limiting embodiments according to the present disclosure are directed to a system for forging a workpiece. The system can comprise a die, an alloy workpiece, and a pad positioned intermediate at least a portion of the die and the alloy workpiece. The pad can comprise a plurality of layers, including a first layer having a first thermal resistance and a first coefficient of friction, and a second layer having a second thermal resistance and a second coefficient of friction. The first thermal resistance can be greater than the second thermal resistance, and the first coefficient of friction can be greater than the second coefficient of friction. In various non-limiting embodiments, first layer comprises KAOWOOL and the second layer comprises fiberglass.

Additional non-limiting embodiments according to the present disclosure are directed to a multi-layer pad for use during a forging operation, wherein the multi-layer pad comprises a first lubricative layer, a second lubricative layer, and a first insulative layer positioned intermediate the first and second lubricative layers. The first lubricative layer can further comprise a workpiece-contacting surface, and the second lubricative layer can further comprise a die-contacting surface. At least one of the first and second lubricative layers can comprise fiberglass, and the first insulative layer can comprise ceramic fibers. The coefficient of friction of the first and second lubricative layers can be less than the coefficient of friction of the first insulative layer and/or the thermal conductivity of the first insulative layer can be less than the thermal conductivity of the first and second lubricative layers. In various non-limiting embodiments, the multi-layer pad can comprise a fastener for fastening at least the first and second lubricative layers relative to each other. Further, in various non-limiting embodiments the first and second lubricative layers can form a sleeve into which the insulative layer is disposed.

Still more non-limiting embodiments according to the present disclosure are directed to a method for hot working a workpiece, the method comprising: heating an alloy workpiece to a temperature above the ambient temperature; positioning a multi-layer pad between the alloy workpiece and a die, wherein the multi-layer pad comprises a lubrication layer and a thermal resistance layer; and hot working the alloy workpiece. Hot working the alloy workpiece can comprise applying a force with the die to the alloy workpiece to plastically deform the alloy workpiece. Applying a force with the die to the alloy workpiece to plastically deform the alloy workpiece can comprise upset forging the alloy workpiece. The method can further comprise positioning a plurality of multi-layer pads between the alloy workpiece and at least one die, pre-forming the alloy workpiece, and/or fabricating an article from the hot worked alloy workpiece. Exposing the workpiece to temperatures above the ambient temperature can comprise heating the alloy workpiece to a temperature above the recrystallization temperature of the alloy and below the melting point temperature of the alloy Further non-limiting embodiments according to the present disclosure are directed to alloy workpieces made or processed according to any of the methods of the present disclosure.

Yet further non-limiting embodiments according to the present disclosure are directed to articles of manufacture made from or including alloy workpieces made or processed according to any of the methods of the present disclosure. Such articles of manufacture include, for example, jet engine components, land based turbine components, valves, engine components, shafts, and fasteners.

DESCRIPTION OF THE DRAWING FIGURES

The various non-limiting embodiments described herein may be better understood by considering the following description in conjunction with the accompanying drawing figures, in which.

Figure 11:
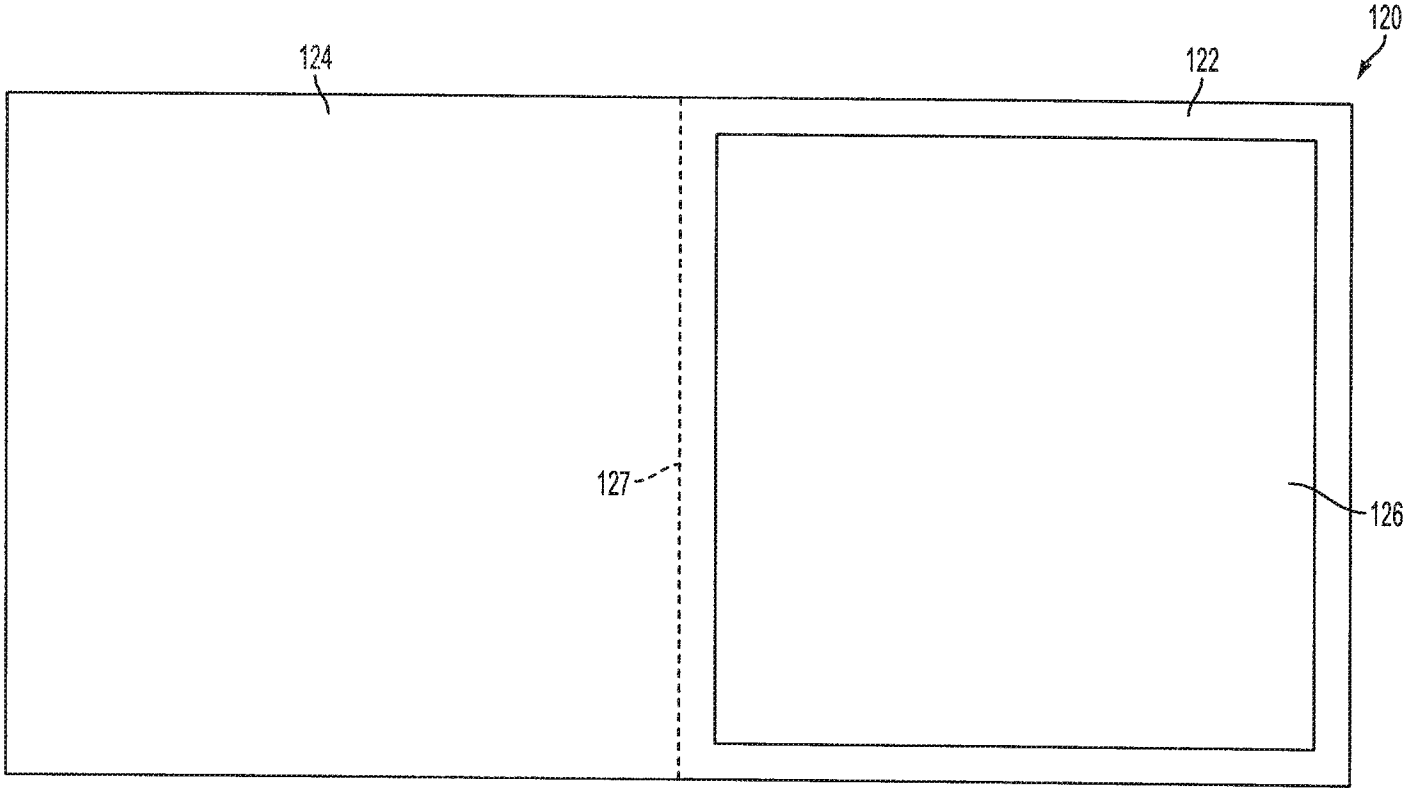
Figure 12:
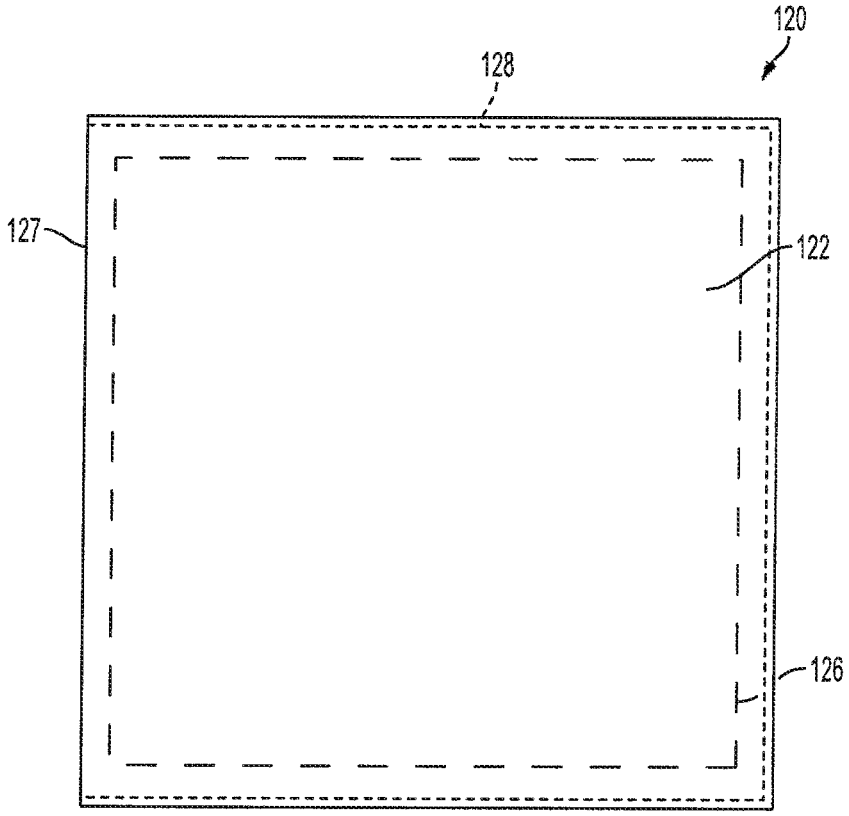

FIG. 11 is a plan view of a multi-layer pad for use in forging operations, depicting the multi-layer pad in a partially-assembled configuration, according to various non-limiting embodiments of the present disclosure; and FIG. 12 is a plan view of the multi-layer pad of FIG. 11, depicting the multi-layer pad in an assembled configuration, according to various non-limiting embodiments of the present disclosure.

DESCRIPTION OF CERTAIN NON-LIMITING EMBODIMENT

It is to be understood that various descriptions of the disclosed embodiments have been simplified to illustrate only those features, aspects, characteristics, and the like that are relevant to a clear understanding of the disclosed embodiments, while eliminating, for purposes of clarity, other features, aspects, characteristics, and the like. Persons having ordinary skill in the art, upon considering the present description of the disclosed embodiments, will recognize that other features, aspects, characteristics, and the like may be desirable in a particular implementation or application of the disclosed embodiments. However, because such other features, aspects, characteristics, and the like may be readily ascertained and implemented by persons having ordinary skill in the art upon considering the present description of the disclosed embodiments, and are, therefore, not necessary for a complete understanding of the disclosed embodiments, a description of such features, aspects, characteristics, and the like is not provided herein. As such, it is to be understood that the description set forth herein is merely exemplary and illustrative of the disclosed embodiments and is not intended to limit the scope of the invention as defined solely by the claims.

In the present disclosure, other than where otherwise indicated, all numbers expressing quantities or characteristics are to be understood as being prefaced and modified in all instances by the term "about." Accordingly, unless indicated to the contrary, any numerical parameters set forth in the following description may vary depending on the desired properties one seeks to obtain in the embodiments according to the present disclosure. For example, the term "about" can refer to an acceptable degree of error for the quantity measured, given the nature or precision of the measurement. Typical exemplary degrees of error may be within 20%, within 10%, or within 5% of a given value or range of values. At the very least, and not as an attempt to limit the application of the doctrine of equivalents to the scope of the claims, each numerical parameter described in the present description should at least be construed in light of the number of reported significant digits and by applying ordinary rounding techniques.

Also, any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value equal to or less than 10. Any maximum numerical limitation recited herein is intended to include all lower numerical limitations subsumed therein, and any minimum numerical limitation recited herein is intended to include all higher numerical limitations subsumed therein. Accordingly, Applicants reserve the right to amend the present disclosure, including the claims, to expressly recite any sub-range subsumed within the ranges expressly recited herein. All such ranges are intended to be inherently disclosed herein such that amending to expressly recite any such sub-ranges would comply with the requirements of 35 U.S.C. §112, first paragraph, and 35 U.S.C. §132(a).

The grammatical articles "one", "a", "an", and "the", as used herein, are intended to include "at least one" or "one or more", unless otherwise indicated. Thus, the articles are used herein to refer to one or more than one (i.e., to at least one) of the grammatical objects of the article. By way of example, "a component" means one or more components, and thus, possibly, more than one component is contemplated and may be employed or used in an implementation of the described embodiments.

Any patent, publication, or other disclosure material that is said to be incorporated by reference herein, is incorporated herein in its entirety unless otherwise indicated, but only to the extent that the incorporated material does not conflict with existing definitions, statements, or other disclosure material expressly set forth in this disclosure. As such, and to the extent necessary, the express disclosure as set forth herein supersedes any conflicting material incorporated by reference herein. Any material, or portion thereof, that is said to be incorporated by reference herein, but which conflicts with existing definitions, statements, or other disclosure material set forth herein is only incorporated to the extent that no conflict arises between that incorporated material and the existing disclosure material. Applicant reserves the right to amend the present disclosure to expressly recite any subject matter, or portion thereof, incorporated by reference herein.

The present disclosure includes descriptions of various non-limiting embodiments. It is to be understood that all embodiments described herein are exemplary, illustrative, and non-limiting. Thus, the invention is not limited by the description of the various exemplary, illustrative, and non-limiting embodiments. Rather, the invention is defined solely by the claims, which may be amended to recite any features expressly or inherently described in or otherwise expressly or inherently supported by the present disclosure. Therefore, any such amendments would comply with the requirements of 35 U.S.C. §112, first paragraph, and 35 U.S.C. §132(a).

The various non-limiting embodiments disclosed and described herein can comprise, consist of, or consist essentially of, the features, aspects, characteristics, limitations, and the like, as variously described herein. The various non-limiting embodiments disclosed and described herein can also comprise additional or optional features, aspects, characteristics, limitations, and the like, that are known in the art or that may otherwise be included in various non-limiting embodiments as implemented in practice.

As used herein, the term "hot working" refers to the application of force to a solid-state workpiece at any temperature greater than ambient temperature, wherein the applied force plastically deforms the workpiece.

During hot working operations, such as, for example, forging operations and extrusion operations, a force may be applied to an alloy ingot or other alloy workpiece at a temperature greater than ambient temperature, such as above the recrystallization temperature of the workpiece, to plastically deform the workpiece. The temperature of an alloy ingot or other alloy workpiece undergoing the hot working operation may be greater than the temperature of the dies or other structures used to mechanically apply force to the surfaces of the workpiece. The alloy ingot or other alloy workpiece may form temperature gradients due to cooling of its surface by heat loss to ambient air and the thermal gradient off-set between its surfaces and the contacting dies or other structures. The resulting thermal gradient off-set between the alloy workpiece surfaces and the interior portions of the alloy workpiece may contribute to cracking of the ingot along its surfaces and/or edges during hot working. Surface cracking is especially problematic in situations in which the alloy ingots or other alloy workpieces are formed from crack sensitive alloys.

Various alloys may be characterized as crack sensitive. Crack sensitive alloys tend to form cracks during working operations. Crack sensitive alloy ingots, for example, may form cracks during hot working operations used to produce alloy articles from the crack sensitive alloy ingots. For example, alloy billets may be formed from alloy ingots using forge conversion. Other alloy articles may be formed from alloy billets or alloy ingots using extrusion or other working operations. The production yield of alloy articles (e.g., alloy billets) formed from crack sensitive alloy ingots using hot working operations may be low because of the incidence of surface cracking of the alloy ingots during the hot working (e.g., during forging or extrusion). The production yields may be reduced by a need to grind off or otherwise remove the surface cracks from a worked ingot.

According to various non-limiting embodiments, various nickel base alloys, iron base alloys, nickel-iron base alloys, titanium base alloys, titanium-nickel base alloys, cobalt base alloys, and superalloys, such as nickel base superalloys, may be crack sensitive, especially during hot working operations. An alloy ingot or other alloy workpiece may be formed from such crack sensitive alloys and superalloys. For example, a crack sensitive alloy workpiece may be formed from alloys or superalloys selected from, but not limited to, Alloy 718 (UNS No. N07718), Alloy 720 (UNS No. N07720), Rene 41 alloy (UNS No. N07041), Rene 65 alloy, Rene 88 alloy, Waspaloy® alloy (UNS No. N07001), and Inconel® 100 alloy.

Figure 1A:
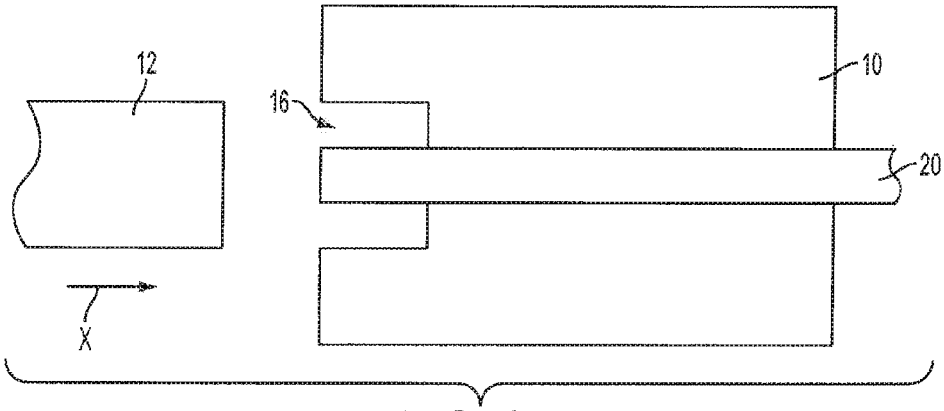
FIGS. 1A-1C are cross-sectional schematic diagrams illustrating an impression die upset forging method for forming a headed fastener.
Figure 1B:
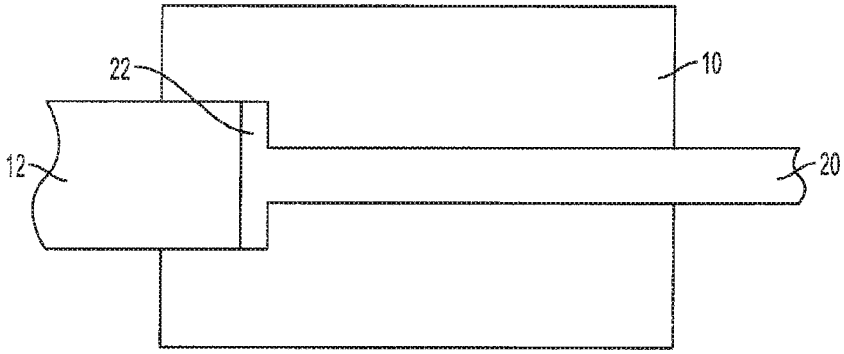
Figure 1C:
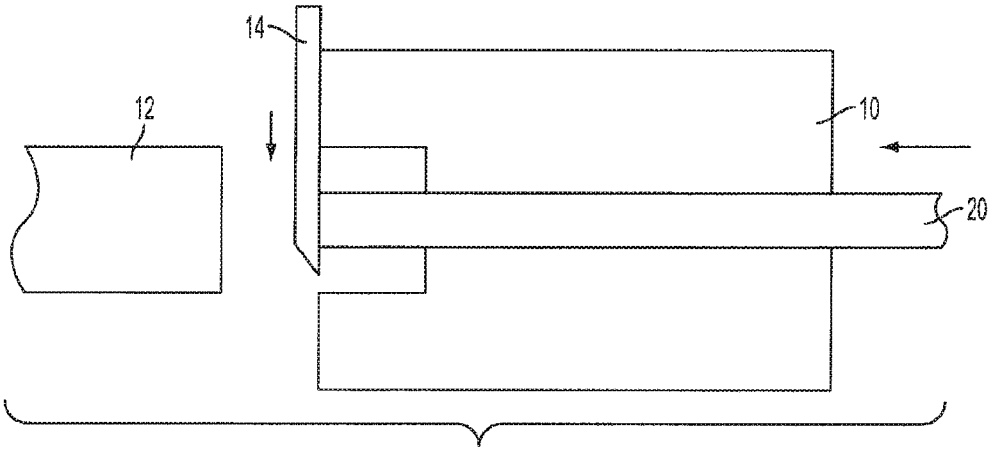

FIGS. 1A-1C depict a hot working upset forging process wherein a fastener is headed. In various non-limiting embodiments, an impression die 10 and a punch 12 can be used to upset forge a portion of a workpiece, such as a wire or metal rod 20, for example. The wire 20 can be heated to a temperature above the ambient temperature, for example, while the die 10 and/or the punch 12 remains at and/or below the ambient temperature. Referring primarily to FIG. 1A, the wire 20 can be held within the die 10, and can extend into an opening or cavity 16 in the die 10. In various non-limiting embodiments, the punch 12 can be moved in a direction "X" toward the die 10. For example, the punch 12 can move into the opening 16 in the die 10 and contact and exert a force on the wire 20. In various non-limiting embodiments, the force exerted on the wire 20 by the punch 12 can deform the wire 20 to form a head 22 (FIG. 1B). In other words, the head 22 can be formed between a contacting surface of the punch 12 and a contacting surface of the die 10. Referring primarily to FIG. 1C, the punch 12 can be removed from the opening 16 and the wire 20 can be advanced through the die 10. In various non-limiting embodiments, a blade 14 can cut the wire 20 such that the formed fastener 24 (shown in FIG. 2A) is released from the forging die 10.

Figure 2A:
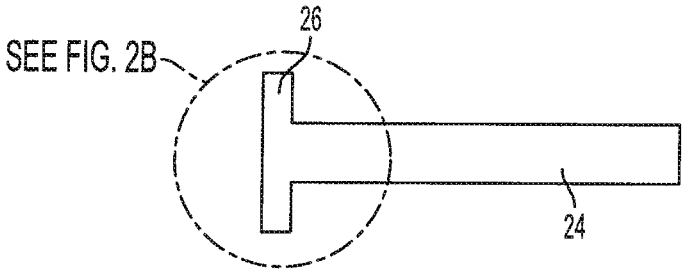
FIG. 2A is an elevational view of a headed fastener formed by the impression die upset forging method depicted in FIGS. 1A-1C.
Figure 2B:
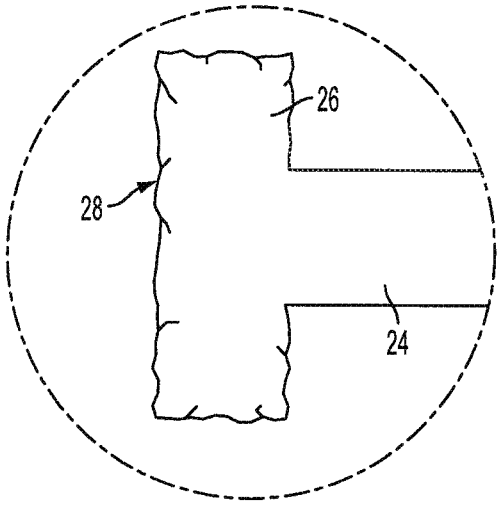
FIG. 2B is a detail view of the head of the headed fastener of FIG. 2A.

In various non-limiting embodiments, the wire 20 can be comprised of a crack sensitive alloy. For example, the wire 20 can be made of a crack sensitive alloy selected from Alloy 718, Alloy 720, Rene 41 alloy, Rene 65 alloy, Rene 88 alloy, Waspaloy® alloy, and Inconel® 100 alloy. In such embodiments, the thermal gradient off-set between the wire 20 and the surfaces of the die 10 and/or the punch 12 that contact the wire 20 can result in cracking along the surfaces and/or edges of the formed fastener 24. Referring to FIGS. 2A and 2B, an exemplary fastener 24 produced by the upset forging hot working process depicted in FIGS. 1A-1C can comprise various cracks along the forged surfaces thereof. For example, referring primarily to FIG. 2B, the surface 28 of the fastener head 26 can comprise various cracks resulting from the thermal gradient off-set during forging of the head 26. In certain non-limiting embodiments, the fastener 24 may require subsequent machining to remove cracked material from the surface 28 thereof.

One technique used to reduce crack formation on the surfaces and edges of alloy ingots or other alloy workpieces during hot working is to place the alloy ingots into an alloy can before hot working. With cylindrical workpieces, for example, the inside diameter of the alloy can is slightly larger than the outside diameter of the alloy workpiece, thereby allowing the insertion of the workpiece into the can. The can loosely surrounds the workpiece, providing an air gap between the can's inner surfaces and the workpiece. During hot working operations, the dies contact the external can, and the can thermally insulates the alloy workpiece by action of the air gaps and also by directly inhibiting the alloy workpiece from radiating heat to the environment. In this manner, the can may thermally insulate and mechanically protect surfaces of the workpiece, which may reduce the incidence of workpiece surface cracking during working.

An alloy workpiece canning operation may result in various disadvantages. For example, mechanical contact between dies and the alloy can's outer surfaces may break apart the can. In one specific case, during repeated upset forging of a canned workpiece, the alloy may break apart between upset forging operations. In such case, the alloy workpiece may need to be re-canned between upset forging operations, which increases process complexity and expense. In another specific case, during upset-and-draw forging of a canned workpiece, the alloy can may break apart during the draw operation. In such case, the alloy workpiece may need to be re-canned between each upset-and-draw cycle of a multiple upset-and-draw forging operation, which increases process complexity and expense. Further, the alloy can may impair an operator from visually monitoring the surface of a canned alloy workpiece for cracks and other work-induced defects.

The following co-owned U.S. patents and patent applications, related to various devices and/or methods for reducing the incidence of surface cracking of an alloy ingot or other alloy workpiece during hot working, are hereby incorporated by reference herein in their respective entireties:

- U.S. Pat. No. 8,230,899, entitled "SYSTEMS AND METHODS FOR FORMING AND PROCESSING ALLOY INGOTS";
- U.S. patent application Ser. No. 12/700,963, entitled "SYSTEMS AND METHODS FOR PROCESSING ALLOY INGOTS", published as U.S. Patent Application Publication No. 2011/0195270;
- U.S. patent application Ser. No. 13/007,692, entitled "HOT WORKABILITY OF METAL ALLOYS VIA SURFACE COATING", published as U.S. Patent Application Publication No. 2012/0183708; and
- U.S. patent application Ser. No. 13/533,142, entitled "SYSTEMS AND METHODS FOR FORMING AND PROCESSING ALLOY INGOTS", published as U.S. Patent Application Publication No. 2012/0279678.

In forging operations, the interface friction between workpiece surfaces and die surfaces may be quantitatively expressed as the frictional shear stress. The frictional shear stress (T) may be expressed as a function of the solid flow stress of the deforming material (σ) and the shear friction factor (m) by the following equation:

$$T = \frac{m}{\sqrt{3}}\sigma.$$

The value of the shear friction factor provides a quantitative measure of lubricity for a forging system. For example, the shear friction factor may range from 0.6 to 1.0 when forging titanium alloy workpieces without lubricants, whereas the shear friction factor may range from 0.1 to 0.3 when hot forging titanium alloy workpieces with certain molten lubricants. Lubricity, quantified as the shear friction factor (m) of a system, may be measured using a ring compression test in which a flat ring-shaped specimen is compressed to a predetermined reduction in height. Ring compression testing is known to those having ordinary skill and is generally described, for example, in Altan et al., *Metal Forming: Fundamentals and Applications*, Ch. 6. "Friction in Metal Forming", ASM: 1993, which is incorporated by reference herein.

Figure 3B:
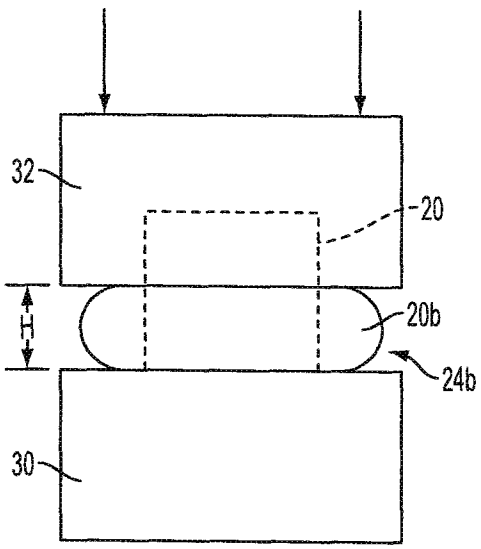
FIG. 3B is a cross-sectional schematic diagram illustrating an open die upset forging system operating under high friction conditions.
Figure 3A:
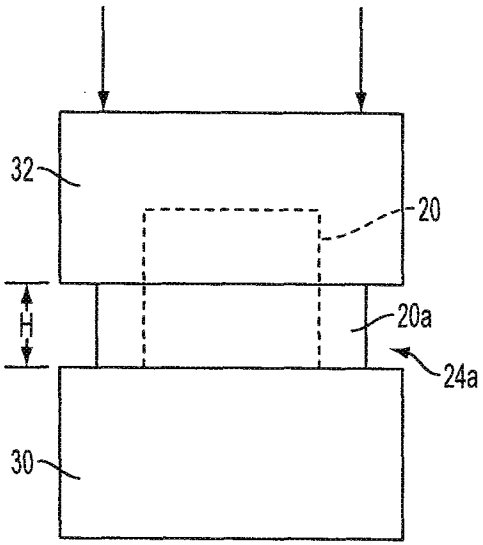
FIG. 3A is a cross-sectional schematic diagram illustrating an open die upset forging system operating under frictionless conditions.

Inadequate forging lubrication, characterized, for example, by a relatively high value of the shear friction factor for a forging operation, may have a number of adverse effects. In forging, the solid-state flow of material is caused by the force transmitted from the dies to the plastically deforming workpiece. The frictional conditions at the die/workpiece interface influence metal flow, formation of surface and internal stresses within the workpiece, stresses acting on the dies, and pressing load and energy requirements. FIGS. 3A and 3B illustrate certain frictional effects in connection with an open die upset forging operation.

FIG. 3A illustrates the open die upset forging of a cylindrical workpiece 20 under ideal frictionless conditions. FIG. 3B illustrates the open die upset forging of an identical cylindrical workpiece 20 under high friction conditions. The upper dies 32 press the workpieces 20 from their initial height (shown by dashed lines) to a forged height H. The upsetting force is applied with equal magnitude and in opposite direction to the workpieces 20 by the upper dies 32 and the lower dies 30. The material forming the workpieces 20 is incompressible and, therefore, the volumes of the initial workpieces 20 and the final forged workpieces 20*a* and 20*b* shown in FIGS. 3A and 3B, respectively, are equal. Under the frictionless conditions illustrated in FIG. 3A, the workpiece 20 deforms uniformly in the axial and radial directions. This is indicated by the linear profile 24*a* of the forged workpiece 20*a*. Under the high friction conditions illustrated in FIG. 3B, the workpiece 20 does not deform uniformly in the axial and radial directions. This is indicated by the curved profile 24*b* of the forged workpiece 20*b*.

In this manner, the forged workpiece 20*b* exhibits "barreling" under high friction conditions, whereas the forged workpiece 20*a* does not exhibit any barreling under frictionless conditions. Barreling and other effects of non-uniform plastic deformation due to die/workpiece interface friction during forging are generally undesirable. For example, in impression die forging, interface friction may cause the formation of void spaces where deforming material does not fill all the cavities in the die. This may be particularly problematic in net-shape or near-net-shape forging operations where workpieces are forged within tighter tolerances. High friction conditions can also cause "die-lock" in which the workpiece sticks to the die(s). "Die-lock" may be particularly undesirable in forging operations involving a contoured die surface in which a workpiece positioned off-center may die-lock and not properly deform to take on the contours of the die. As a result, forging lubricants may be employed to reduce interface friction between the die surfaces and the workpiece surfaces during forging operations.

The following co-owned U.S. patent applications, related to various devices and/or methods for decreasing the shear factor for a forging system, are hereby incorporated by reference herein in their respective entireties:

- U.S. patent application Ser. No. 12/814,591, entitled "LUBRICATION PROCESSES FOR ENHANCED FORGEABILITY", published as U.S. Patent Application Publication No. 2011/0302978; and
- U.S. patent application Ser. No. 13/027,327, entitled "LUBRICATION PROCESSES FOR ENHANCED FORGEABILITY", published as U.S. Patent Application Publication No. 2011/0302979.

According to certain non-limiting embodiments, a method of hot working an alloy ingot or other alloy workpiece according to the present disclosure may generally comprise using a multi-layer pad between the alloy ingot or other alloy workpiece and the forging die or other forging structure to eliminate or reduce surface cracking of the alloy ingot or other alloy workpiece. In addition to eliminating or reducing surface cracking, the multi-layer pad according to the present disclosure can also lubricate surfaces of the alloy ingot or other alloy workpiece during hot working operations. The multi-layer pad can comprise at least two layers. In various non-limiting embodiments, the multi-layer pad can comprise at least three layers. In at least one non-limiting embodiments, the multi-layer pad can comprise at least one lubricative layer to reduce friction between the alloy ingot or other alloy workpiece and the die or other forging structure, for example. Furthermore, in at least one non-limiting embodiment, the multi-layer pad can comprise at least one insulative layer to thermally insulate the alloy ingot or other alloy workpiece from the die or other forging structure, for example. In various non-limiting embodiments, the multi-layer pad can comprise a thermally insulative layer positioned intermediate two lubricative layers. In various non-limiting embodiments, the thickness of the insulative layer (s) and the lubricative layer(s) can depend on the material properties of the workpiece, the temperature gradient between the workpiece and the forging die, and the material (s) of the multi-layer pad, for example. In certain non-limiting embodiments, the thermally insulative layer(s) can be sufficiently thick to thermally insulate the workpiece from the die, and the lubricative layer(s) can be sufficiently thick to reduce friction between the workpiece and the die during forging. In various non-limiting embodiments, the thermally insulative layer(s) can be thicker than the lubricative layer(s) or vice versa, for example.

Figure 7:
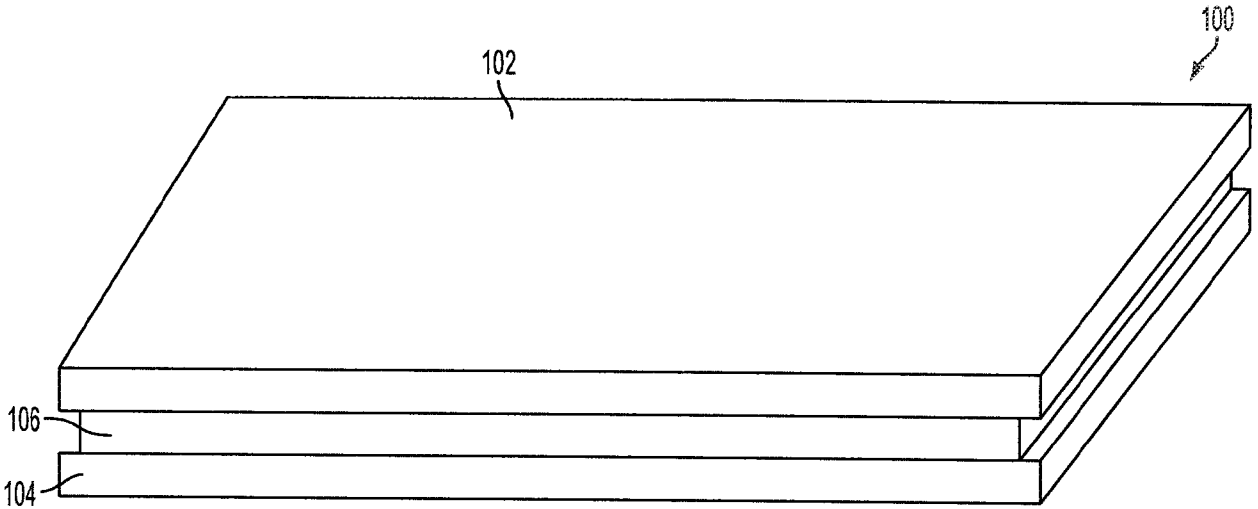
FIG. 7 is a perspective view of a multi-layer pad for use in forging operations, according to various non-limiting embodiments of the present disclosure.
Figure 8:
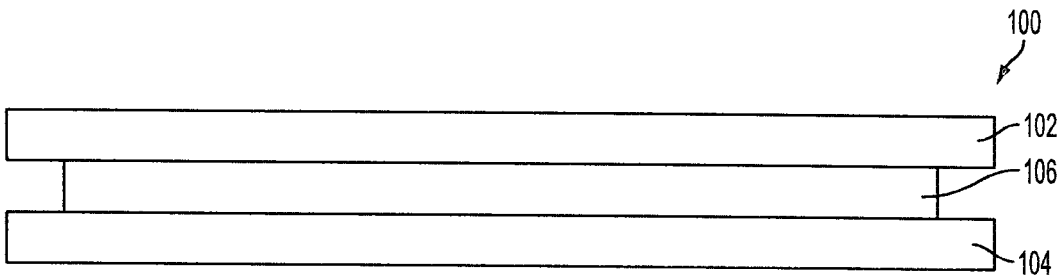
FIG. 8 is an elevational view of the multi-layer pad of FIG. 7, according to various non-limiting embodiments of the present disclosure.

Referring now to FIGS. 7 and 8, a non-limiting embodiment of a multi-layer pad 100 that reduces thermal cracking according to the present disclosure may generally comprise a plurality of layers 102, 104, 106. At least one of the plurality of layers can be a lubricative layer, for example, which can reduce friction between the alloy ingot or other alloy workpiece and the die or other forging structure. At least one layer can be a thermally insulative layer, for example, which can thermally insulate the alloy ingot or other alloy workpiece from the die or other forging structure. In various non-limiting embodiments, a lubricative layer can form an outer layer of the multi-layer pad 100, such that the lubricative layer contacts the workpiece and/or the die, for example. In certain non-limiting embodiments, a lubricative layer can form the outer layers of the multi-layer pad 100, such that the lubricative layers contact both the workpiece and the die or other forging structure, for example. In certain non-limiting embodiments, a first outer lubricative layer can comprise a workpiece-contacting surface, for example, and a second outer lubricative layer can comprise a die-contacting surface, for example.

Referring still to FIGS. 7 and 8, in an exemplary embodiment of the present disclosure, the layers 102 and 104 can be lubricative layers, which can reduce friction between the workpiece and the die. Furthermore, the layer 106 can be a thermally insulative layer, which can thermally insulate the workpiece from the die. In various non-limiting embodiments, the insulative layer 106 can be positioned between the lubricative layers 102 and 104. In various non-limiting embodiments, the multi-layer pad 100 can include additional layers. For example, the multi-layer pad can include a plurality of insulative layers between the outer lubricative layers. In other non-limiting embodiments, the multi-layer pad can include a plurality of alternating insulative and lubricative layers, for example.

Figure 9:
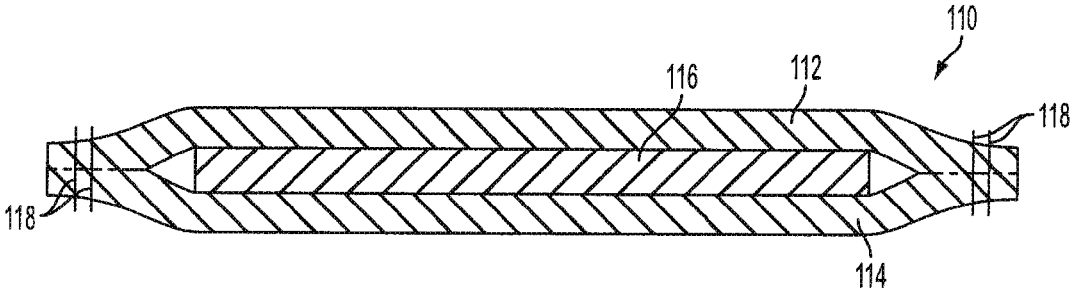
FIG. 9 is a cross-sectional elevational view of a multi-layer pad for use in forging operations, according to various non-limiting embodiments of the present disclosure.
Figure 10:
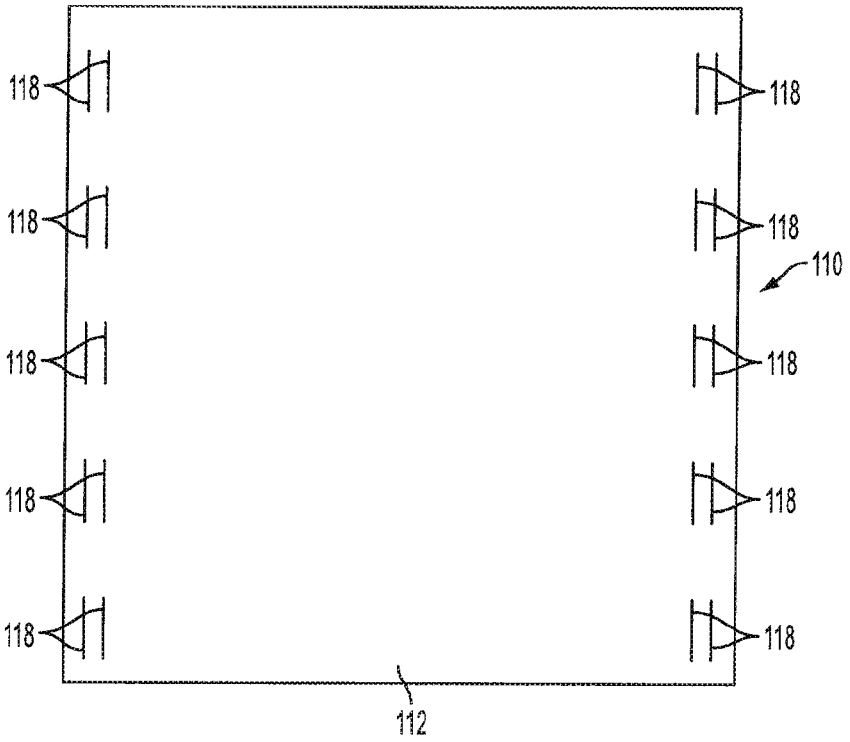
FIG. 10 is a plan view of the multi-layer pad of FIG. 9, according to various non-limiting embodiments of the present disclosure.

In various non-limiting embodiments, the layers of a multi-layer pad can be secured or held together. For example, referring now to FIGS. 9 and 10, staples 118 can secure at least two layers 112, 114, 116 of a multi-layer pad 110 together. In certain non-limiting embodiments, the multi-layer pad 110 can comprise a thermally insulative layer 116 sandwiched between two lubricative layers 112, 114 (FIG. 9), for example. Staples 118 can pierce through the lubricative layers 112 and 114 to form a sleeve or pocket, for example. In various non-limiting embodiments, the thermally insulative layer 116 can be slid or otherwise positioned within the sleeve formed by the joined or stapled outer lubricative layers 112 and 114. In various non-limiting embodiments, rows of staples 118 can extend along the multi-layer pad 110. For example, rows of staples 118 can extend along two lateral sides of the multi-layer pad 110. The insulative layer 116 can be slid through a non-stapled side and/or portion of the multi-layer pad 110, for example. In various non-limiting embodiments, at least one staple 118 can pierce through the inner, insulative layer 116. For example, the insulative layer 116 can be positioned between the outer, lubricative layers 112, 114, and a staple 118 can be applied through the outer and inner layers 112, 114, and 116, for example. In such non-limiting embodiments, the staple 118 can hold the inner, insulative layer 116 relative to the outer, lubricative layers 112 and 114, for example.

Referring now to FIGS. 11 and 12, stitching 128 (FIG. 12) can secure the layers 122, 124, 126 of a multi-layer pad 120 together. In certain non-limiting embodiments, the multi-layer pad 120 can comprise a thermally insulative layer 126 sandwiched between two lubricative layers 122 and 124 for example. In various non-limiting embodiments, the lubricative, outer layers 122 and 124 can be formed from a sheet of lubricative material. The sheet of lubricative material can be folded along a line 127 to form a sleeve or pocket, for example, and stitching can hold the outer, lubricative layers 122 and 124 together. In certain non-limiting embodiments, the stitching 128 can extend around at least a portion of the perimeter of the multi-layer pad 110. The stitching can extend along the non-folded edges of the multi-layer pad 120, for example. In various non-limiting embodiments, the thermally insulative layer 126 can be slid or otherwise positioned within the sleeve formed by the outer lubricative layers 122 and 124. In certain non-limiting embodiments, at least a portion of the stitching 128 can extend through the inner, thermally insulative layer 126. In such non-limiting embodiments, the stitching 128 can hold the inner, thermally insulative layer 126 relative to the outer, lubricative layers 122 and 124.

In various non-limiting embodiments, a thermally insulative layer for thermally insulating a workpiece from a forging die according to the present disclosure can comprise a plurality of ceramic fibers. According to certain non-limiting embodiments, the plurality of the ceramic fibers may comprise a bundle, a strip or tow, a fabric, and/or a board. As generally used herein the term "fabric" refers to materials that may be woven, knitted, felted, or fused, to non-woven materials, or to materials that otherwise are constructed of fibers. In certain non-limiting embodiments, the fabric may comprise a binder to hold the plurality of fibers together. In certain non-limiting embodiments, the fabric may comprise one or more of a yarn, a blanket, a mat, a paper, a felt, and the like. In certain non-limiting embodiments, the thermally insulative layer can comprise a ceramic fabric such as, for example, a ceramic fabric comprising fire clay fibers. For example, the thermally insulative layer can comprise KAOWOOL fabric, a material known to those having ordinary skill and which comprises alumina-silica fire clay. In various embodiments, the thermally insulative layer can be sufficiently thermally resistant to protect the hot worked workpiece from the cooler die and/or to prevent or significantly reduce thermal transfer between the two bodies. The thermal resistance of the insulative layer can be greater than the thermal resistance of the lubricative layer of the multi-layer pad, for example. In various non-limiting embodiments, the thermal conductivity of the insulating material can range from 1.45 BTU·in/(hr·ft$^{2}$·° F.) to 2.09 BTU·in/(hr·ft$^{2}$·° F.) for temperatures between 1500° F. and 2000° F. (816° C. and 1093° C.), for example.

The thicknesses of the insulative layer(s) of a multi-layer pad may vary according to the thermal conductivity of the fabric. In certain non-limiting embodiments, the fabric may have a thickness of 0.5", 1.0" or 2", for example. Furthermore, the forms and thicknesses of the one or more thermally insulative layers of the multi-layer pad may take into account the temperature range over which alloys may be hot worked, e.g., the temperature at which cracks initiate in the particular alloy that is to be worked. At a given starting temperature for a hot working operation, some alloys may be effectively hot worked over a larger temperature range than other alloys because of differences in the temperature at which cracks initiate in the alloy. For alloys having a relatively small hot working temperature range (i.e., the difference between the lowest temperature at which the alloy may be hot worked and the temperature at which cracks initiate), the thickness of the one or more thermally insulative layers, and thus, the thickness of the multi-layer pad, may be relatively greater to inhibit or prevent the workpiece from cooling to a brittle temperature range in which cracks initiate. Likewise, for alloys having a relatively large hot working temperature range, the thickness of the one or more thermally insulative layers, and thus, the thickness of the multi-layer pad, may be relatively smaller to inhibit or prevent the underlying alloy ingot or other alloy workpiece from cooling to a brittle temperature range in which cracks initiate. In various non-limiting embodiments, a plurality of insulative layers can be stacked and/or layered to achieve a thickness sufficient to provide the desired insulative effect.

In various non-limiting embodiments, a lubricative layer for reducing friction between a workpiece and a forging die according to the present disclosure can comprise fiberglass. Fiberglass can comprise a melting point between 1650° F. and 2050° F. (899° C.-1121° C.), for example, and can comprise $SiO_2$, Al2$O_3$, $B_2O_3$TiO, and/or CaO, for example. In certain non-limiting embodiments, the lubricative layer can have a low coefficient of friction. The lubricative layer can have a coefficient of friction that is less than the coefficient of friction of the workpiece and/or the die, for example. In certain non-limiting embodiments, the lubricative layer can have a coefficient of friction that is less than the coefficient of friction of the insulative layer, for example. In various embodiments, the coefficient of friction for the lubricative layer at the forging temperature can range from 0.8 to 1.0, for example. Conversely, the coefficient of friction for metals can range from 0.3-0.9, depending on the alloy and temperature.

According to certain non-limiting embodiments, a method of processing an alloy ingot or other alloy workpiece to reduce thermal cracking may generally comprise initial formation of a workpiece. An alloy ingot or other alloy workpiece described herein may be formed using, for example, conventional metallurgy techniques or powder metallurgy techniques. For example, in various non-limiting embodiments, an alloy ingot or other alloy workpiece may be formed by a combination of vacuum induction melting (VIM) and vacuum arc remelting (VAR), known as a VIM-VAR operation. In various other non-limiting embodiments, an alloy workpiece may be formed by a triple melt technique, in which an electroslag remelting (ESR) operation is performed intermediate a VIM operation and a VAR operation, providing a VIM-ESR-VAR (i.e., triple melt) sequence. In other non-limiting embodiments, an alloy workpiece may be formed using a powder metallurgy operation involving atomization of molten alloy and the collection and consolidation of the resulting metallurgical powders into an alloy workpiece.

In certain non-limiting embodiments, an alloy ingot or other alloy workpiece may be formed using a spray forming operation. For example, VIM may be used to prepare a base alloy composition from a feedstock. An ESR operation may optionally be used after VIM. Molten alloy may be extracted from a VIM or ESR melt pool and atomized to form molten droplets. The molten alloy may be extracted from a melt pool using a cold wall induction guide (CIG), for example. The molten alloy droplets may be deposited into a mold or onto a mandrel or other surface using a spray forming operation to form a solidified alloy workpiece.

In certain non-limiting embodiments, an alloy ingot or other alloy workpiece may be formed using hot isostatic pressing (HIP). HIP generally refers to the isostatic application of a high pressure and high temperature gas, such as, for example, argon, to compact and consolidate powder material into a monolithic preform. The powder may be separated from the high pressure and high temperature gas by a hermetically sealed container, which functions as a pressure barrier between the gas and the powder being compacted and consolidated. The hermetically sealed container may plastically deform to compact the powder, and the elevated temperatures may effectively sinter the individual powder particles together to form a monolithic preform. A uniform compaction pressure may be applied throughout the powder, and a homogeneous density distribution may be achieved in the preform. For example, a near-equiatomic nickel-titanium alloy powder may be loaded into a metallic container, such as, for example, a steel can, and outgassed to remove adsorbed moisture and entrapped gas. The container containing the near-equiatomic nickel-titanium alloy powder may be hermetically sealed under vacuum, such as, for example, by welding. The sealed container may then be HIP'ed at a temperature and under a pressure sufficient to achieve full densification of the nickel-titanium alloy powder in the container, thereby forming a fully-densified near-equiatomic nickel-titanium alloy preform.

After initial workpiece formation, a non-limiting method of processing an alloy ingot or other alloy workpiece to reduce thermal cracking may generally comprise heating the workpiece and/or conditioning the surface of the workpiece. In certain non-limiting embodiments, an alloy workpiece may be exposed to high temperatures to homogenize the alloy composition and microstructure of the workpiece. The high temperatures may be above the recrystallization temperature of the alloy but below the melting point temperature of the alloy. An alloy workpiece may be surface conditioned, for example, by grinding and/or peeling the surface of the workpiece. A workpiece may also be sanded and/or buffed, for example. Surface conditioning operations may be performed before and/or after any optional heat treatment steps, such as, for example, homogenization at high temperatures.

Figure 4B:
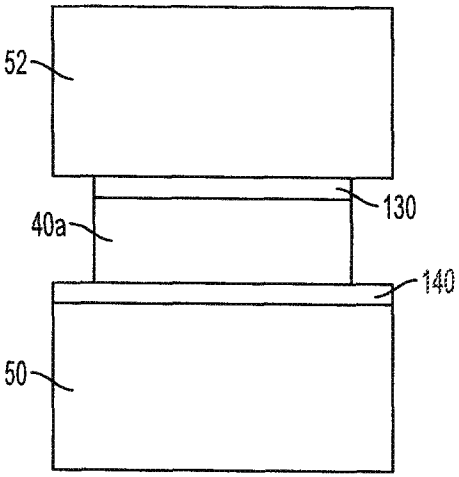
FIGS. 4A and 4B are cross-sectional schematic diagrams illustrating an open die upset forging operation with a multi-layer pad positioned between the open die and the workpiece, according to various non-limiting embodiments of the present disclosure.
Figure 4A:
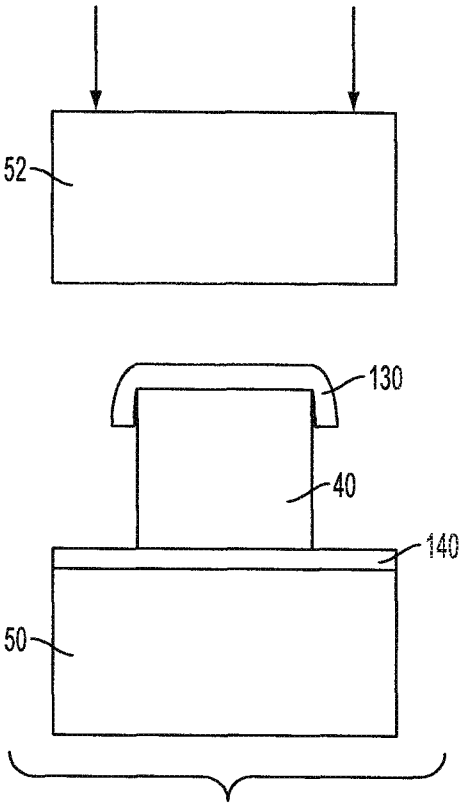

According to certain non-limiting embodiments, a method of processing an alloy ingot or other alloy workpiece to reduce thermal cracking may generally comprise hot working the workpiece. Hot working the workpiece may comprise applying a force to the workpiece to plastically deform the workpiece. The force may be applied with, for example, dies and/or rolls. In various non-limiting embodiments, a multi-layer pad according to the present disclosure can be positioned between at least a portion of the workpiece and at least a portion of the die(s) or other forging structure. For example, referring now to FIGS. 4A and 4B, hot working a workpiece 40 can comprise upset forging the workpiece 40 in an open die. The open die can comprise a first die portion 50 and a second die portion 52, for example. In various non-limiting embodiments, the workpiece 40 can be clamped between the first and second die portions 50, 52 such that the workpiece 40 is plastically deformed (FIG. 4B) therebetween. In certain non-limiting embodiments, a multi-layer pad 130, 140, can be positioned between at least a portion of the workpiece 40 and one of the die portions 50, 52. For example, a first multi-layer pad 140 can be positioned between the first die portion 50 and the workpiece 40, and a second multi-layer pad 130 can be positioned between the second die portion 52 and the workpiece 40, for example. The multi-layer pad 130, 140 can be secured to the workpiece 40 and/or to the die 40, 50. In various embodiments, the multi-layer pad 130, 140 can be placed on the workpiece 40 and held in position by gravity, for example. The multi-layer pad 130, 140 may have any suitable width and length to cover at least a portion of the pre-deformed workpiece 40 and/or the deformed workpiece 40*a*. The width and length of the multi-layer pad 130, 140 may vary according to the size and/or shape of the workpiece 40 and the die 40,50, for example. In various non-limiting embodiments, the multi-layer pads 130, 140 may cover the entire interface between the workpiece 40 and the die portions 50, 52, for example. In other non-limiting embodiments, the multi-layer pads 130, 140 may only partially cover the interface between the workpiece 40 and the die portions 50, 52, for example.

Figure 5:
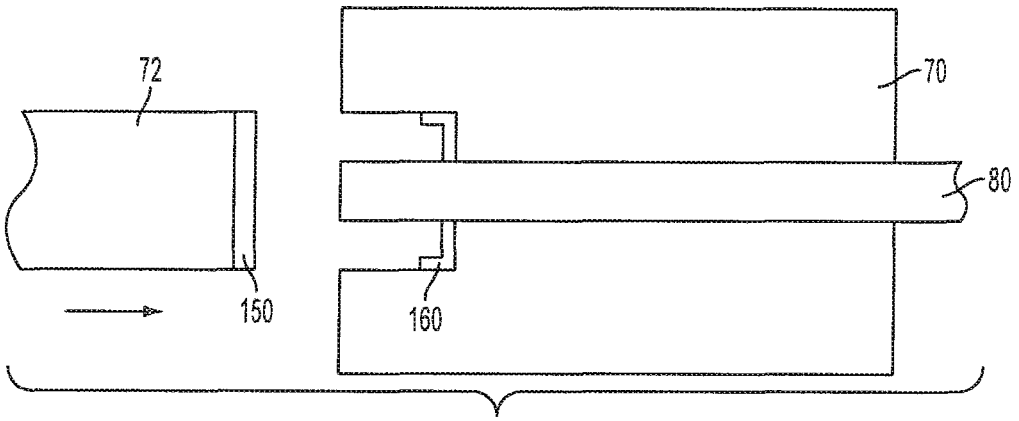
FIG. 5 is a schematic diagram illustrating an impression die upset forging system with a multi-layer pad positioned between the impression die and the workpiece, according to various non-limiting embodiments of the present disclosure.

Referring now to FIG. 5, hot working a workpiece 80 can comprise upset forging the workpiece 80 in an impression die 70. The impression die 70 can include a punch 72, for example, which can include an impression and/or a substantially flat punching surface, for example. In various non-limiting embodiments, the workpiece 80 can be clamped between the impression die 70 and the punch 72 such that the workpiece 80 is plastically deformed therebetween. In certain non-limiting embodiments, a multi-layer pad 150, 160, can be positioned between at least a portion of the workpiece 80 and the die 70 and/or the punch 72. For example, a first multi-layer pad 150 can be positioned between at least a portion of the punch 72 and at least a portion of the workpiece 80, and a second multi-layer pad 160 can be positioned between at least a portion of the impression die 70 and at least a portion of the workpiece 80, for example. The multi-layer pad 150, 160 can be secured to the workpiece 80 and/or to the die 70 and/or the punch 72, for example. In various embodiments, the multi-layer pad 150, 160 can be placed on the workpiece 80 and held in position by gravity, for example. The multi-layer pad 150, 160 may have any suitable width and length to cover at least a portion of the workpiece 80. The width and length of the multi-layer pad 150, 160 may vary according to the size and/or shape of the workpiece 80. In various non-limiting embodiments, the multi-layer pads 150, 160 may cover the entire interface between the workpiece 80 and the die portions 70, 72, for example. In other non-limiting embodiments, the multi-layer pads 150, 160 may only partially cover the interface between the workpiece 80 and the die portions 70, 72, for example.

Figure 6A:
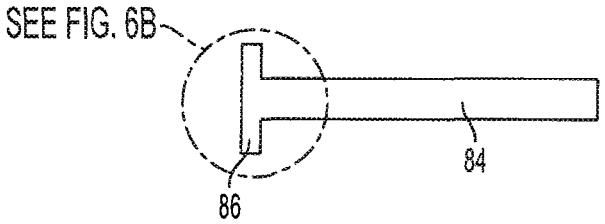
FIG. 6A is an elevational view of a headed fastener formed by the impression die upset forging system depicted in FIG. 5, according to various non-limiting embodiments of the present disclosure.
Figure 6B:
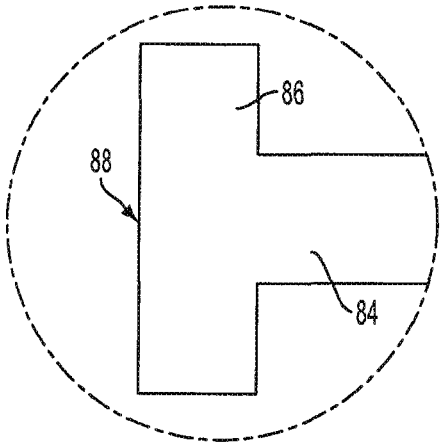
FIG. 6B is a detail view of the head of the headed fastener of FIG. 6A, according to various non-limiting embodiments of the present disclosure.

Referring now to FIGS. 6A and 6B, a fastener 84 formed by the impression die upset forging system depicted in FIG. 5, i.e., using multi-layer pads 150, 160 positioned between the workpiece 80 and the impression die 70 and between the workpiece 80 and the punch 72, can include a fastener head 86. As shown in FIG. 6B, the fastener head 86 formed during the upset forging operation can comprise an outer surface 88 that is substantially free of surface cracks, for example. Comparatively, the fastener 24 (FIGS. 2A and 2B) formed by the impression die upset forging operation depicted in FIGS. 1A-1C, i.e., without the use of a multi-layer pad, includes significantly greater surface cracks on the outer surface 24 thereof.

In certain non-limiting embodiments, hot working the workpiece may comprise hot working the workpiece at a temperature from 1500° F. to 2500° F. Of course, as will be apparent to those having ordinary skill, the temperature range at which hot working may occur for a particular alloy workpiece will be influenced by factors including, for example, the alloy composition and microstructure, the workpiece size and shape, and the particular hot working technique employed. In certain non-limiting embodiments, hot working the workpiece may comprise a forging operation and/or an extrusion operation. For example, a workpiece may be upset forged and/or draw forged. In various non-limiting embodiments, the method may comprise hot working the workpiece by forging. In various non-limiting embodiments, the method may comprise hot working the workpiece by forging at a temperature from 1500° F. to 2500° F. In various non-limiting embodiments, the method may comprise hot working the workpiece by extruding. In various non-limiting embodiments, the method may comprise hot working the workpiece by extruding at a temperature from 1500° F. to 2500° F.

An upset-and-draw forging operation may comprise one or more sequences of an upset forging operation and one or more sequences of a draw forging operation. During an upset operation, the end surfaces of an alloy ingot or other alloy workpiece may be positioned between forging dies that apply force to the workpiece and that compress the length of the workpiece and increase the cross-section of the workpiece. A multi-layer pad according to the present disclosure can be positioned between the forging dies and the end surfaces of the alloy ingot or other alloy workpiece, for example. During a draw operation, the side surfaces (e.g., the circumferential surface of a cylindrical workpiece) may be positioned between forging dies that apply force to the alloy ingot or other alloy workpiece that compresses the cross-section of the workpiece and increases the length of the workpiece. A multi-layer pad according to the present disclosure can be positioned between the forging dies and the side surfaces of the alloy ingot or other alloy workpiece, for example.

In various non-limiting embodiments, an alloy ingot or other alloy workpiece may be subjected to one or more upset-and-draw forging operations. For example, in a triple upset-and-draw forging operation, a workpiece may be first upset forged and then draw forged. The upset and draw sequence may be repeated two more times, for a total of three sequential upset and draw forging operations. In various non-limiting embodiments, a workpiece may be subjected to one or more extrusion operations. For example, in an extrusion operation, a cylindrical workpiece may be forced through a circular die, thereby decreasing the diameter and increasing the length of the workpiece. Other hot working techniques will be apparent to those having ordinary skill, and the multi-layer pads and methods according to the present disclosure may be adapted for use with one or more of such other techniques without the need for undue experimentation.

Although the methods described herein are advantageous for use in connection with crack sensitive alloys, it will be understood that the methods also are generally applicable to any alloy, including, for example, alloys characterized by a relatively low ductility at hot working temperatures, alloys hot worked at temperatures from 1000° F. to 2200° F., and alloys not generally prone to cracking. As used herein, the term "alloy" includes conventional alloys, superalloys, and metals including only incidental levels of other elements. As is understood by those having ordinary skill in the art, superalloys exhibit relatively good surface stability, corrosion and oxidation resistance, high strength, and high creep resistance at high temperatures.

Alloy workpieces that may be processed according to the various embodiments herein may be in any suitable form. In particular non-limiting embodiments, for example, the alloy workpieces may comprise or be in the form of ingots, billets, bars, plates, tubes, sintered pre-forms, and the like.

In various non-limiting embodiments, the methods disclosed herein may be used to produce a wrought billet from an alloy ingot in the form of a cast, consolidated, or spray formed ingot. The forge conversion or extrusion conversion of an ingot to a billet or other worked article may produce a finer grain structure in the article as compared to the former workpiece. The methods and processes described herein may improve the yield of forged or extruded products (such as, for example, billets) from workpieces because the multi-layer pad according to the present disclosure may reduce the incidence of surface cracking of the workpiece during the forging and/or extrusion operations. For example, it has been observed that a multi-layer pad according to the present disclosure provided between at least a region of a surface of a workpiece and a die may more readily tolerate the strain induced by working dies. It also has been observed that a multi-layer pad according to the present disclosure provided between at least a region of a surface of a workpiece and a die may also more readily tolerate the temperature differential between the working dies and the workpiece during hot working. In this manner, it has been observed that surface crack initiation is prevented or reduced in the underlying workpiece during working.

In various non-limiting embodiments, alloy ingots or other alloy workpieces of various alloys having a multi-layer pad according to the present disclosure disposed thereon may be hot worked to form products that may be used to fabricate various articles. For example, embodiments of the processes described herein may be used to form billets from any of a nickel base alloy, an iron base alloy, a nickel-iron base alloy, a titanium base alloy, a titanium-nickel base alloy, a cobalt base alloy, a nickel base superalloy, and other superalloys. Billets or other products formed from hot worked ingots or other alloy workpieces may be used to fabricate articles including, but not limited to, turbine components, such as, for example, disks and rings for turbine engines and various land-based turbines. Other articles fabricated from alloy ingots or other alloy workpieces processed according to various non-limiting embodiments described herein may include, but are not limited to, valve components, engine components, shafts, and fasteners.

The present disclosure has been written with reference to various exemplary, illustrative, and non-limiting embodiments. However, it will be recognized by persons having ordinary skill in the art that various substitutions, modifications, or combinations of any of the disclosed embodiments (or portions thereof) may be made without departing from the scope of the invention as defined solely by the claims. Thus, it is contemplated and understood that the present disclosure embraces additional embodiments not expressly set forth herein. Such embodiments may be obtained, for example, by combining, modifying, or reorganizing any of the disclosed steps, ingredients, constituents, components, elements, features, aspects, characteristics, limitations, and the like, of the embodiments described herein. Thus, this disclosure is not limited by the description of the various exemplary, illustrative, and non-limiting embodiments, but rather solely by the claims. In this manner, Applicants reserve the right to amend the claims during prosecution to add features as variously described herein.

What is claimed is:

1. A system for forging a workpiece, the system comprising:

a die;

an alloy workpiece; and a pad positioned intermediate at least a portion of the die and at least a portion of the alloy workpiece, wherein the pad comprises a plurality of layers including:

a first layer comprising a first thermal resistance and a first coefficient of friction, wherein the first layer comprises ceramic fibers;

a second layer comprising a second thermal resistance and a second coefficient of friction; and a third layer comprising a third thermal resistance and a third coefficient of friction, wherein the second layer and the third layer each comprise fiberglass, the first thermal resistance is greater than the second thermal resistance and the third thermal resistance, the first coefficient of friction is greater than the second coefficient of friction and the third coefficient of friction, the second and third layers of the plurality of layers are secured together to form a sleeve, and the first layer is positioned within the sleeve.

2. The system of claim 1, wherein the first layer comprises KAOWOOL.

3. The system of claim 1, wherein the first layer comprise fire clay fibers.

4. The system of claim 1, wherein the second layer further comprises a workpiece-contacting surface, and wherein the third layer further comprises a die-contacting surface.

5. The system of claim 1, wherein the alloy workpiece comprises one of an ingot, a billet, a bar, a plate, a tube, and a sintered pre-form.

6. The system of claim 1, wherein the alloy workpiece comprises a material selected from the group consisting of a nickel base alloy, a nickel base superalloy, an iron base alloy, a nickel-iron base alloy, a titanium base alloy, a titanium-nickel base alloy, and a cobalt base alloy.

7. The system of claim 6, wherein the alloy workpiece comprises a material selected from the group consisting of Alloy 718 (UNS No. N07718), Alloy 720 (UNS No. N07720), Rene 41 alloy (UNS No. N07041), Rene 65 alloy, Rene 88 alloy, WASPALOY® alloy (UNS No. N07001), and INCONEL®100 alloy.

8. The system of claim 1, wherein the die comprises an upset forging die and a punch, wherein the pad is positioned between at least a portion of the upset forging die and the alloy workpiece, wherein the system further comprises a second pad, and wherein the second pad is positioned between at least a portion of the punch and the alloy workpiece.

9. The system of claim 1, wherein the second and third layers of the plurality of layers are secured together by at least one fastener.

10. The system of claim 1, wherein the second and third layers of the plurality of layers are secured together by at least one of stitching or at least one staple.

* * * * *